US011382825B2

(12) United States Patent
Wu

(10) Patent No.: US 11,382,825 B2
(45) **Date of Patent: *Jul. 12, 2022**

(54) MASSAGE ROLLER MECHANISM

(71) Applicants: Dong-Her Wu, Chang-Hua Hsien (TW); IREST HEALTH SCIENCE AND TECHNOLOGY CO., LTD, Iaxing (CN)

(72) Inventor: Dong-Her Wu, Chang-Hua Hsien (TW)

(73) Assignees: Dong-Her Wu, Chang-Hua Hsien (TW); IREST HEALTH SCIENCE AND TECHNOLOGY CO., LTD, Jiaxing (CN)

( * ) Notice: Subject to any disclaimer, the term of this patent is extended or adjusted under 35 U.S.C. 154(b) by 284 days.

This patent is subject to a terminal disclaimer.

(21) Appl. No.: 16/558,311

(22) Filed: Sep. 3, 2019

(65) Prior Publication Data

US 2020/0206071 A1 Jul. 2, 2020

(30) Foreign Application Priority Data

Dec. 28, 2018 (TW) ..... 107147804

(51) Int. Cl.
*A61H 15/00* (2006.01)

(52) U.S. Cl.
CPC . *A61H 15/0078* (2013.01); *A61H 2015/0021* (2013.01); *A61H 2201/1215* (2013.01); *A61H 2201/1676* (2013.01)

(58) Field of Classification Search
CPC ..... A61H 15/00; A61H 15/0078; A61H 2015/0021; A61H 2015/0035; A61H 2201/0119; A61H 2201/1215; A61H 2201/1642; A61H 2201/1676; A61H 2201/164; A61H 2201/50; A61H 2201/1671; A61H 2201/0149; A61H 2201/1207; A61H 7/004; A61H 2205/10; A61H 2205/088; A61H 2205/108; A61H 2205/12; A61H 2205/106; A61H 2205/125; A61H 2203/0431; A61H 2203/0443; A61H 1/0214; A61H 1/024; A61H 1/0244; A61H 1/0255; A61H 1/0259; A61H 1/0266; A61H 1/0237; A47C 1/034; A47C 1/0355; A47C 7/5066; A47C 7/5068

See application file for complete search history.

(56) References Cited

U.S. PATENT DOCUMENTS 3,116,955 A * 1/1964 Siegal ..... A47C 7/5066 297/423.35
4,782,823 A * 11/1988 Yamasaki ..... A61H 15/0078 601/127
5,551,951 A * 9/1996 Fradkin ..... A61H 15/00 601/115

(Continued)

*Primary Examiner* — Colin W Stuart
*Assistant Examiner* — Douglas Y Sul

(57) ABSTRACT

A massage roller mechanism has two round disks and a plurality of massaging units between the two round disks, a shaft connecting the two round disks, a plurality of through apertures evenly and respectively disposed around the shaft on the two round disks. The massaging unit utilizes an elastic band to connect a plurality of massage beans, and the massaging units are secured onto each through aperture between the two round disks via the elastic band.

6 Claims, 13 Drawing Sheets

(56) References Cited

U.S. PATENT DOCUMENTS

| | | | | |
|---|---|---|---|---|
| 6,056,709 | A * | 5/2000 | Hashimoto | A61H 15/0078 601/118 |
| 7,192,406 | B2 * | 3/2007 | Marten | A61H 15/0078 601/127 |
| 2004/0030274 | A1 * | 2/2004 | Wu | A61H 15/0078 601/115 |
| 2005/0090769 | A1 * | 4/2005 | Chen | A61H 15/0078 601/99 |
| 2006/0006724 | A1 * | 1/2006 | Shimizu | A61H 7/004 297/423.26 |
| 2011/0034839 | A1 * | 2/2011 | Yang | A61H 15/0078 601/128 |
| 2015/0021969 | A1 * | 1/2015 | Yin | A47C 7/506 297/423.26 |
| 2020/0206069 | A1 * | 7/2020 | Wu | A61H 15/0078 |

* cited by examiner

MASSAGE ROLLER MECHANISM

BACKGROUND OF INVENTION

Field of Invention

The present invention relates to a massage mechanism, and more particularly to a massage roller mechanism.

Description of the Related Art

In modern life, people are under various stress and are easily suffer body aches. Therefore, various massage devices are employed to massage different parts of the body to ease the body tension. The general massage devices are divided into a body massage device such as a massage chair, a massage bed, etc., and a partial massage device such as a shoulder-neck massage belt, a waist massage belt or a calf and foot massage machine, etc. All of them employ rollers, airbags or vibration to generate mechanical press on corresponding body parts to relieve the tension of the muscles.

However, the current massage chairs, massage beds or lower limb massage devices all have complex massage mechanisms, which cause the equipment to be bulky, and it is difficult to place and store. The massage wheels or massage arms of the massage mechanisms described above uses rigid shaft and rocking arm to drive the massage beans, which cannot be adjusted according to the user's body shape and curve. The fixed massage angle cannot provide conforming effect to different users, which easily cause pain and discomfort to the user.

Therefore, it is desirable to provide a massage roller mechanism to mitigate and/or obviate the aforementioned problems.

SUMMARY OF THE INVENTION

An objective of present invention is to provide a massage roller mechanism, which is capable of improving the above-mention problems.

In order to achieve the above mentioned objective, A massage roller mechanism has two round disks and a plurality of massaging units between the two round disks, a shaft connecting the two round disks, a plurality of through apertures evenly and respectively disposed around the shaft on the two round disks. The massaging unit utilizes an elastic band to connect a plurality of massage beans, and the massaging units are secured onto each through aperture between the two round disks via the elastic band.

Other objects, advantages, and novel features of invention will become more apparent from the following detailed description when taken in conjunction with the accompanying drawings.

DETAILED DESCRIPTION OF THE PREFERRED EMBODIMENT

Figure 1:
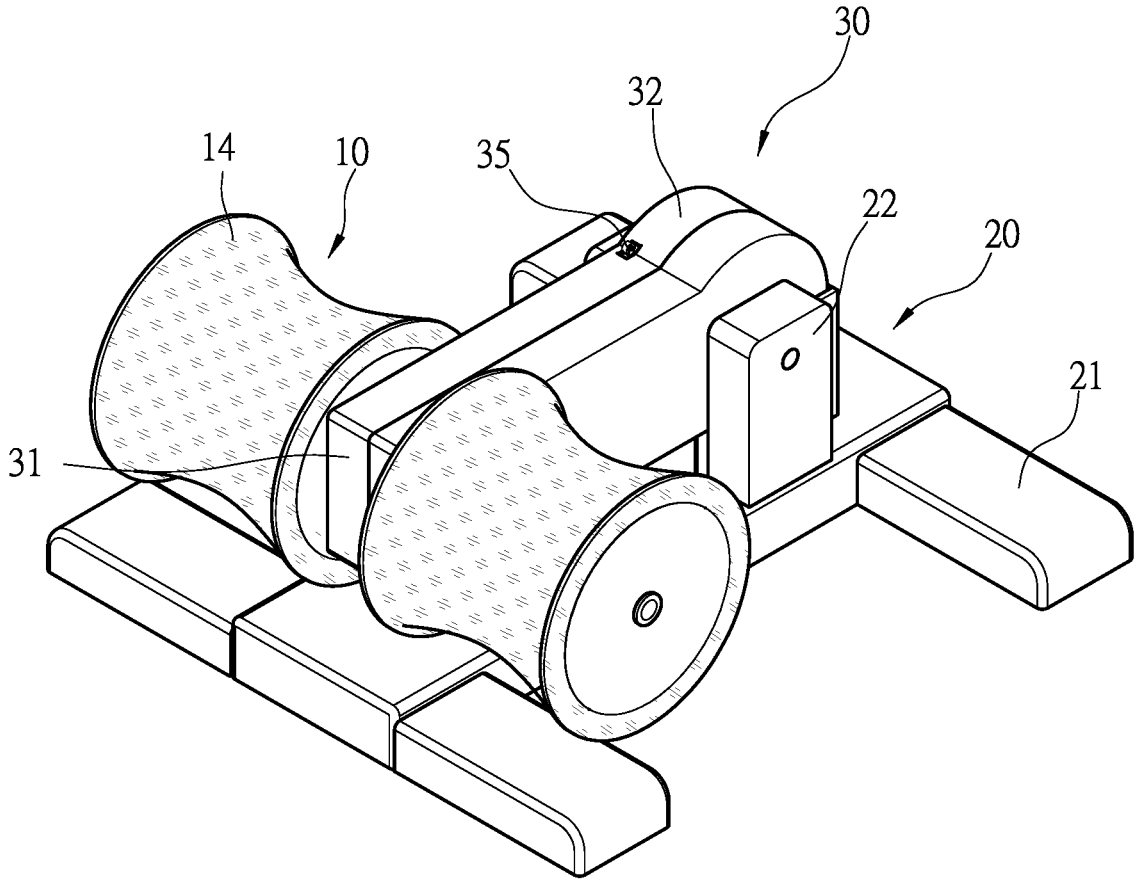
FIG. 1 is a perspective view of a preferred embodiment according to the present invention.
Figure 2:
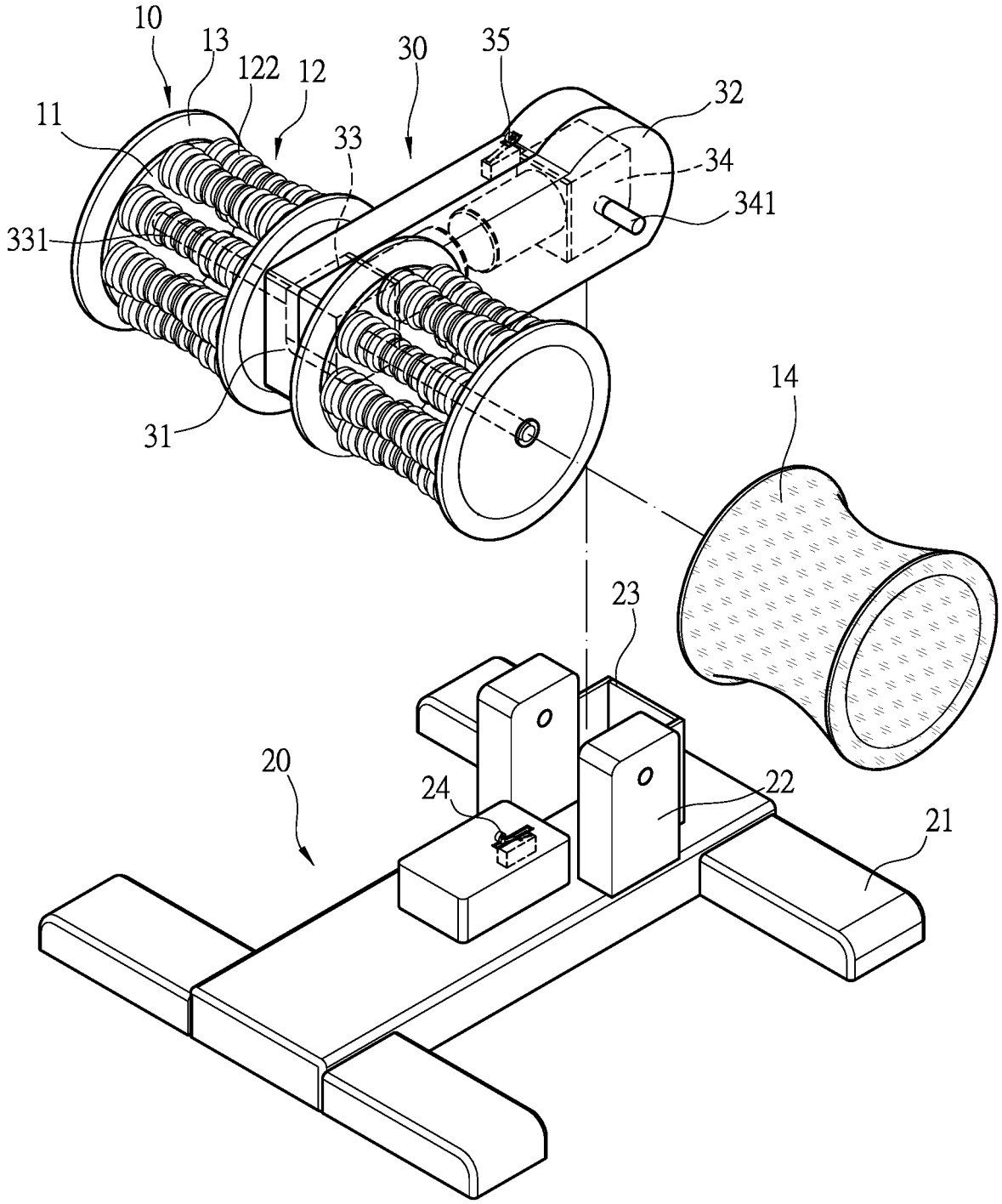
FIG. 2 is an exploded view of the preferred embodiment according to the present invention.
Figure 3:
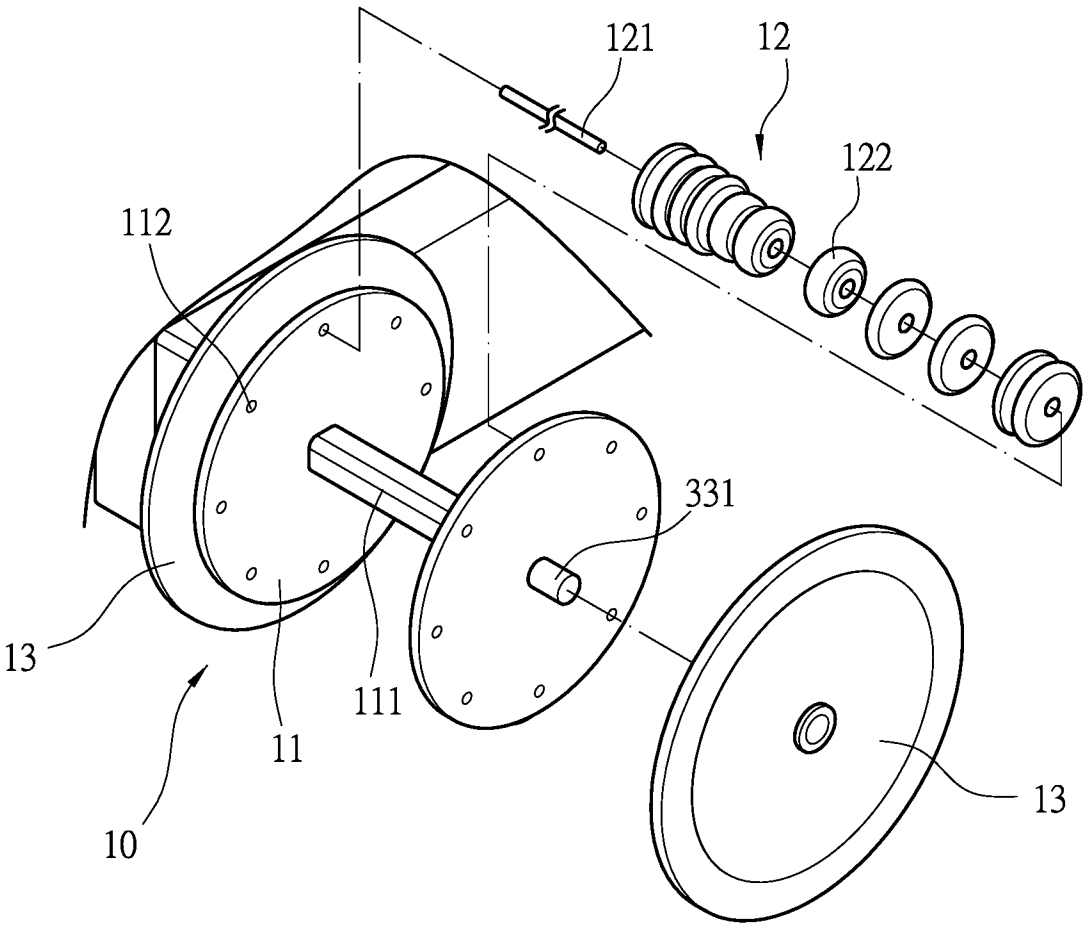
FIG. 3 is a local detail of the massage roller of the preferred embodiment according to the present invention.
Figure 4:
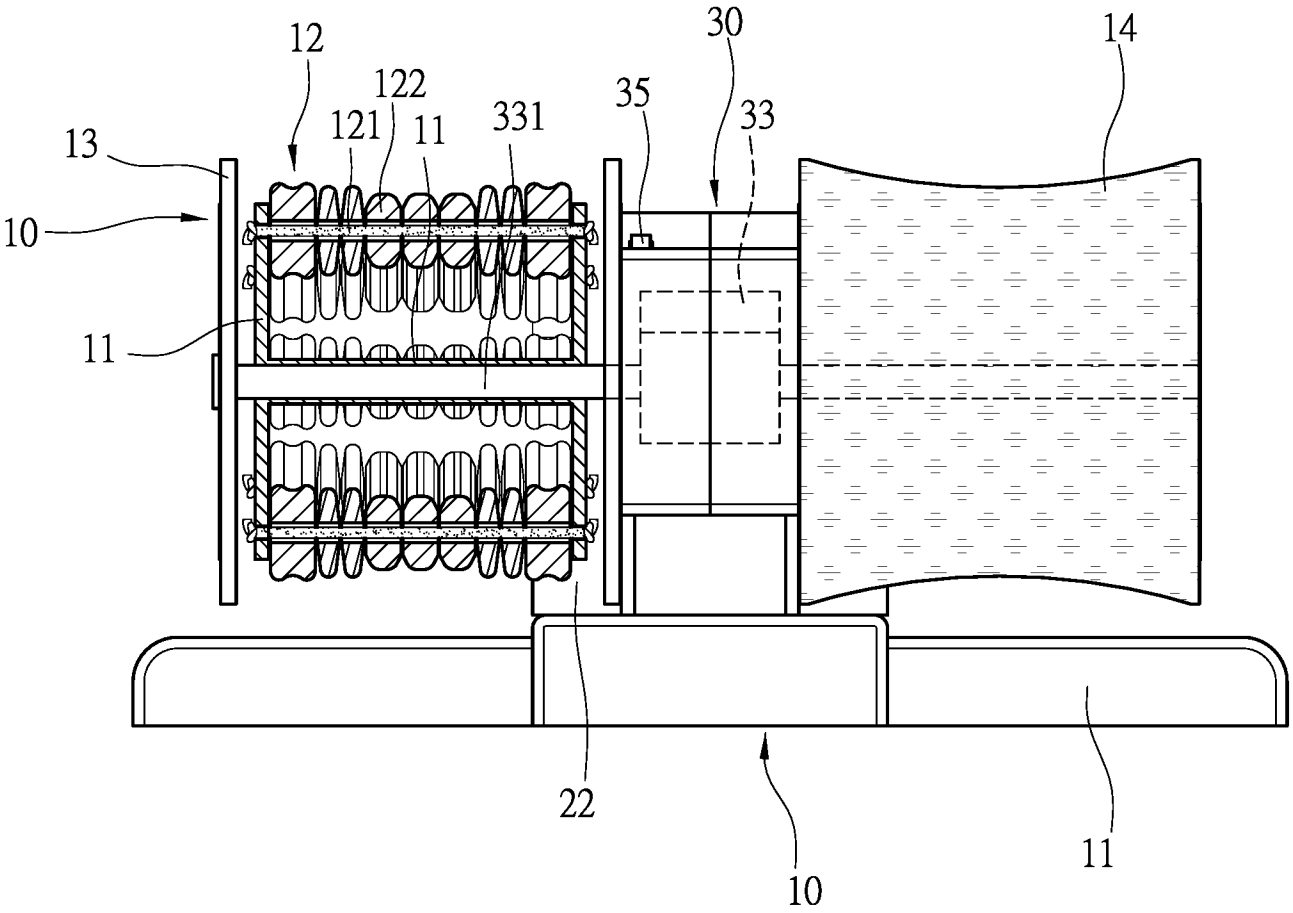
FIG. 4 is a cross-sectional view of the preferred embodiment according to the present invention.

First, please refer to FIGS. 1-4. A massage roller mechanism 10 comprises two round disks 11 and a plurality of massaging units 12 between the two round disks 11. A shaft 111 connects the two round disks 11 at their center, and a plurality of through apertures 112 are evenly and respectively disposed around the shaft 111 on the two round disks 11. The massaging unit 12 utilizes an elastic band 121 to connect a plurality of massage beans 122, and the massaging units 12 are secured onto each through aperture 112 between the two round disks 11 via the elastic band 12. Each side of the two round disks 11 of the massage roller 10 is provides with an outer disk 13.

The massage roller 10 is employed in a massage device. Please refer to FIGS. 1-4 again. The rotatable leg massage device comprises: a base 20 and a swinging arm 30. Two sides of the base 20 are each provided with a foot stand 21, and the base 20 further has two opposing assembling posts 22 and a limiting baffle 23 behind and between the two assembling posts 22. The limiting baffle 23 is U-shaped, and a highest point of the limiting baffle 23 is lower than the two assembling posts 22 such that the swinging arm 30 is able to have a rotation angle larger than 90° relative to the base 20. The swinging arm 30 has a massaging end 21 and a swinging end 32. The massaging end 31 end provided with a respective massaging roller 23 on two sides. The two massaging rollers 10 are both covered by a cloth cover 14. The massaging end 31 further comprises a first motor 24, the first motor 33 drives a central shaft 31 to rotate with the shaft 111 of the two massaging rollers 10 together. The swinging end 32 is disposed between the two assembling posts 22 of the base 20, and a second motor 34 is disposed between the swinging end 32 and the two assembling posts 22 and configured to drive the swinging arm around the base. The second motor 34 is mounted in the swinging end 32 of the swing arm 20, and both ends of the second motor 34 have a shaft rod 341 passing through the swinging end 32 and engaged with the two assembling posts 22. The second motor 34 drive the swinging arm 30 to rotate around the base 20.

Moreover, a first limit switch 24 is mounted in front of the two assembling posts 22 of the base 20, a second limit switch 26 is mounted on the swinging arm 30 adjacent the swinging end 32, and the first and second limit switches 14, 26 are both are electrically connected to the second motor. 25.

For structural assembly and operation, please refer to FIGS. 1-4 again. The massaging end 31 of the swinging arm 30 is rotated by the first motor 33 and drives the two massaging rollers 10 to rotate, the swinging end 32 of the swinging arm 30 is provided with the second motor 34, and the swinging end 32 is mounted between the two assembling posts 22 of the base 20 and the limiting baffle 23. Since the second motor 34 is fixed on the swinging end 32 and the two shaft rods 251 passing through the swinging end 32 are fixed to the sides of the two assembling posts 22. When the two shaft rods 251 are fixed, the second motor 34 operates with the shaft rod 341 as the axis to drive the swinging arm 30 to swing between the two assembling posts 22. The first limit switch 24 is disposed in front of the two assembling posts 22 of the base 20 and the swinging arm 30 has the second limit switch 35 on its outside, when the swinging arm 30 is driven by the second motor 34 and swinging forward and to touch the first limit switch 24 of the base 20, the second switch 35 is activated to make the second motor 34 to rotate reversely to swing the swinging arm 30 in the opposite direction. Conversely, when the swinging arm 30 swings back and touches the limiting baffle 23 with the second limit switch 35, the second motor 34 is switched back to a forward rotation and causing the swinging arm 30 to swinging forward toward the front of the base 20. Therefore, the swinging arm 30 accomplishes reciprocating swing movements, and the massaging rollers 10 of the massaging end 31 provide the massage effect of the lower limbs. Moreover, the limiting baffle 23 is lower than the two assembling posts 22, which allows the swinging arm 30 to have a swing angle greater than 90 degrees on the base 20 and greatly increases the massage range for the lower limbs.

In addition, the previous switching method of the second motor 34 by using the limit switch is only one of the preferred embodiment of the present invention, and is not limited thereto, it can also be accomplished by setting a predetermined numbers of rotation of the second motor 34, other sensing switches or gyroscopes for the switching, etc. to provide the switching effect for the rotation direction of the second motor 34.

Figure 5:
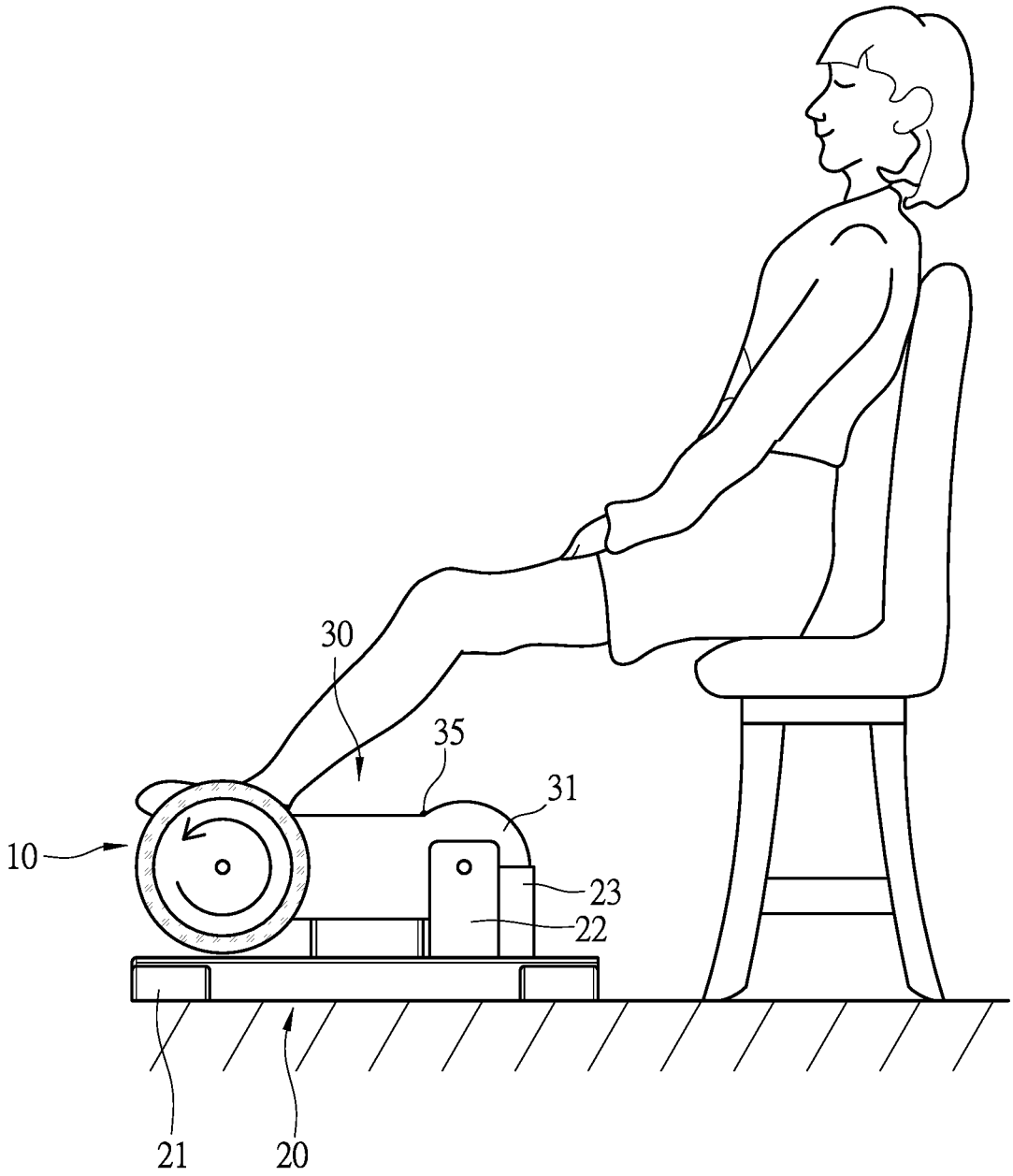
FIG. 5 is a schematic view showing a user sitting on the preferred embodiment according to the present invention.
Figure 6:
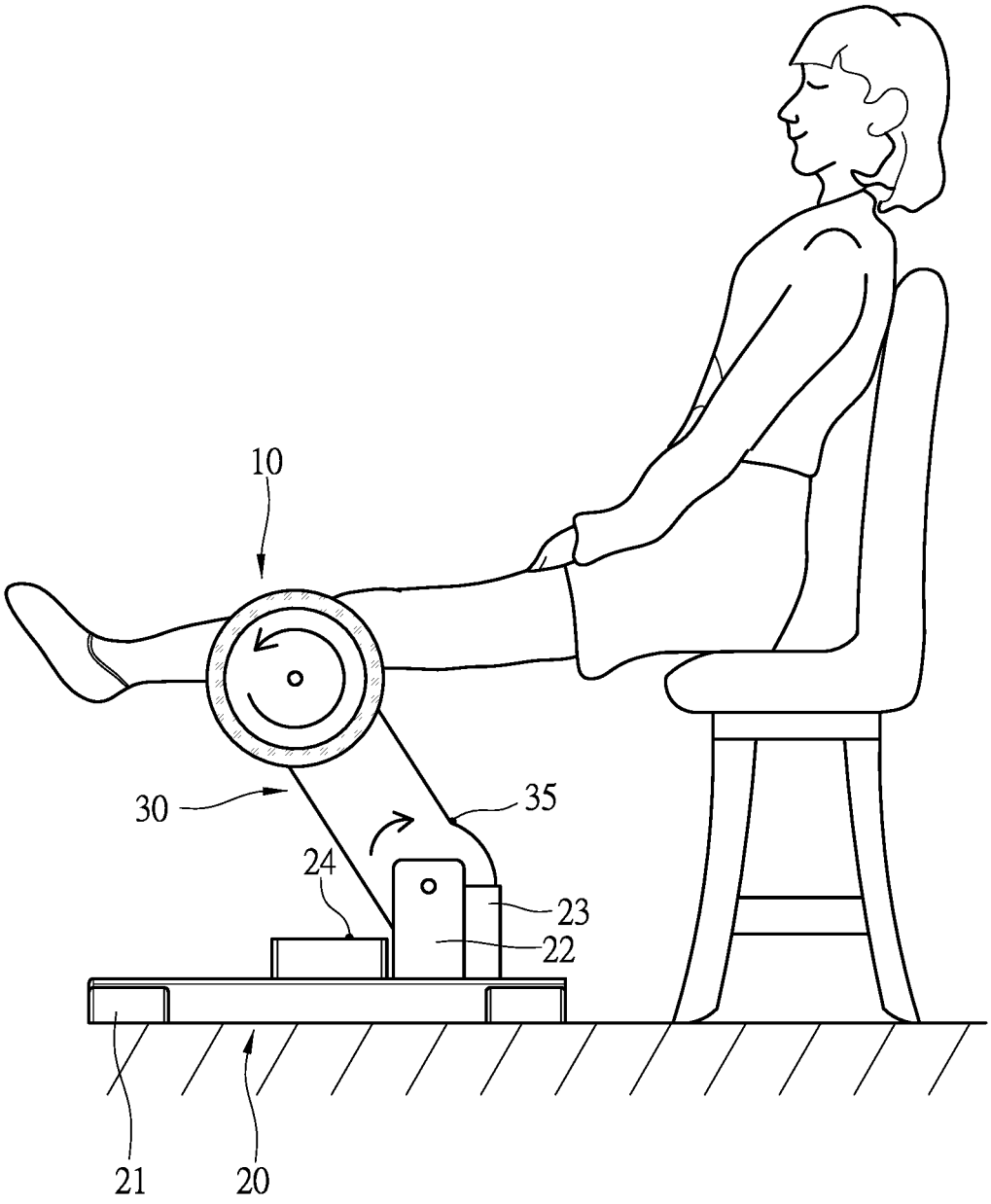
FIG. 6 is another schematic view showing a user sitting on the preferred embodiment according to the present invention.
Figure 7:
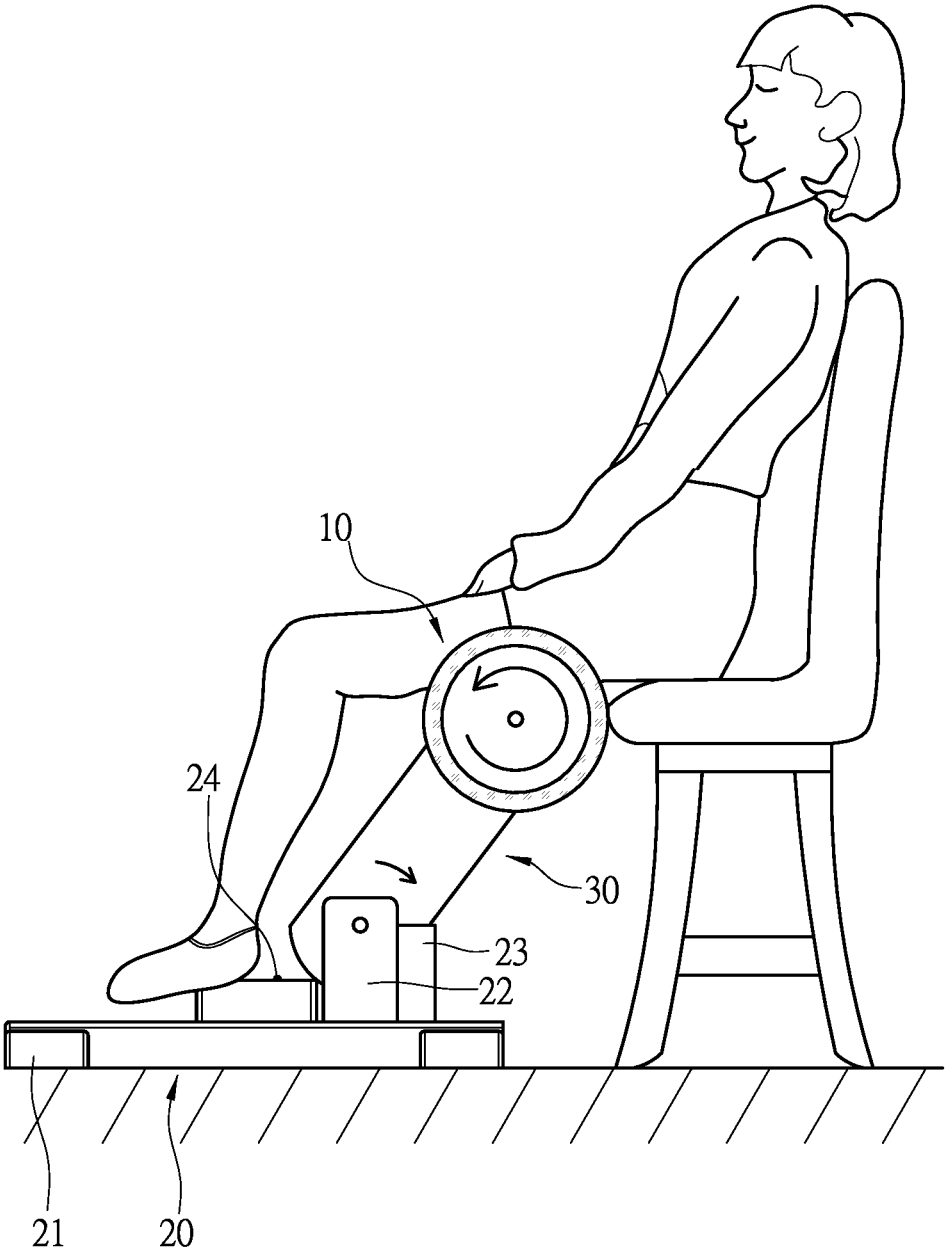
FIG. 7 is another schematic view showing a user sitting on the preferred embodiment according to the present invention.

When the above structure is actually operated, as shown in FIGS. 5, 6 and 7, the user sits on a chair, the massage device is placed in front of the chair, and user's feet are placed on the swinging arm 30. When the first motor 33 and the second motor 34 are simultaneously activated, the two massaging rollers 10 are rotated by the first motor 33 and massage the lower limb muscles via the massaging unit 233, while the swinging arm 30 moves with the second motor 34, and the two massaging rollers 10 of the massaging end 31 massages along the feet, ankles, calves, back of the knees and thighs to achieve a lower limb circulation massage. Furthermore, when the calves are been massaged, the feet can be lifted up to relax the leg muscles, which greatly enhances the massage effect.

Secondly, the first motor 33 and the second motor 34 are connected to a controller (not shown), and the power of the first motor 33 can be controlled by the controller to adjust the speed of the two massaging rollers 10 and the massage force. The controller can also be used to control the second motor 34 to be on or off, and by fixing the angle of the swinging arm 30 to provide a fixed-point massage at the sole of the foot, the calf muscle, the muscle of the back of the knee or the thigh muscle.

Figure 8:
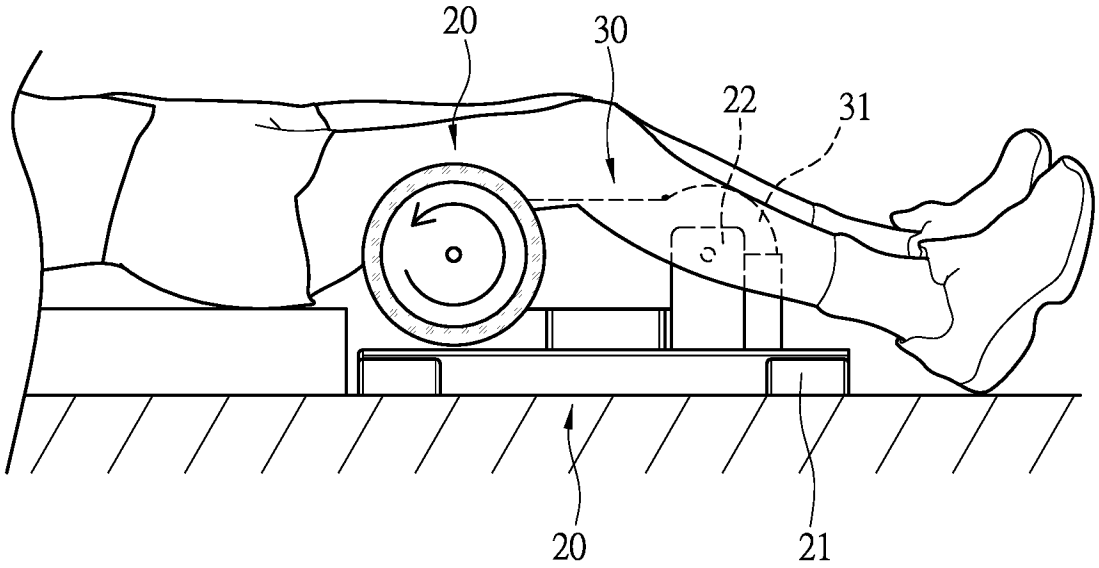
FIG. 8 is a schematic diagram showing the user lying down on the preferred embodiment according to the present invention.
Figure 9:
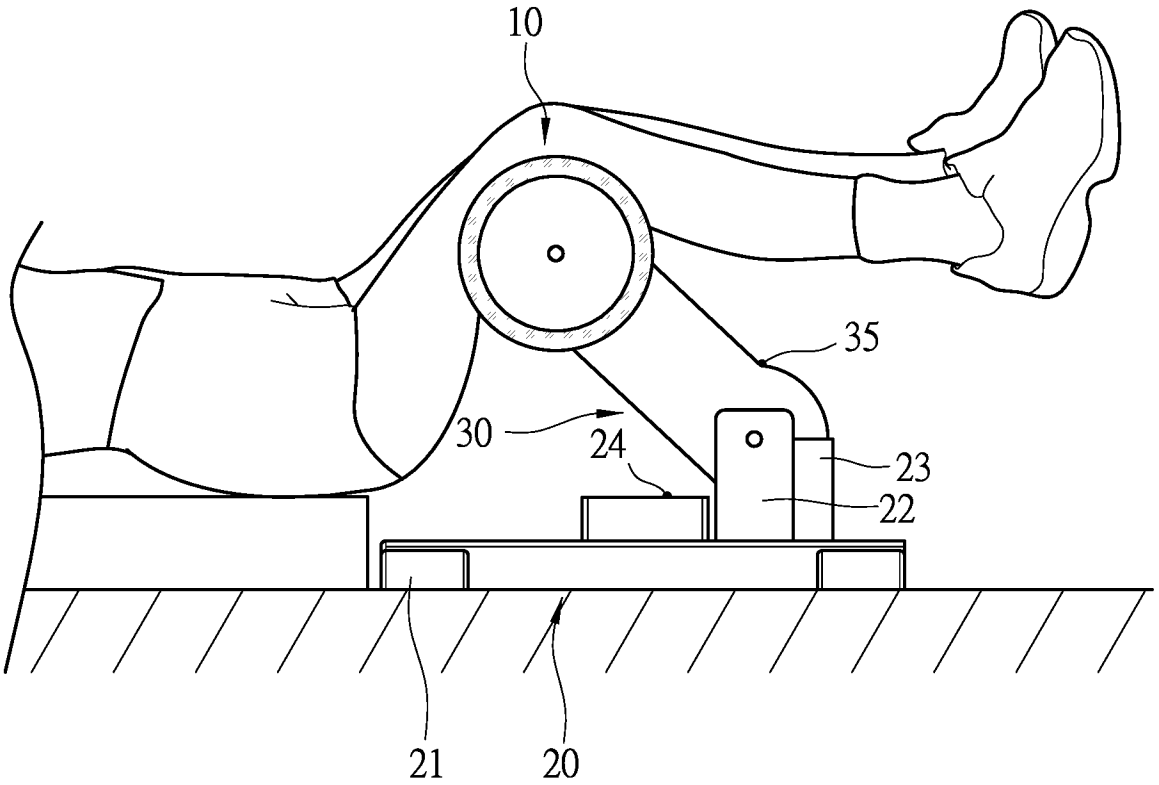
FIG. 9 is another schematic diagram showing the user lying down on the preferred embodiment according to the present invention.
Figure 10:
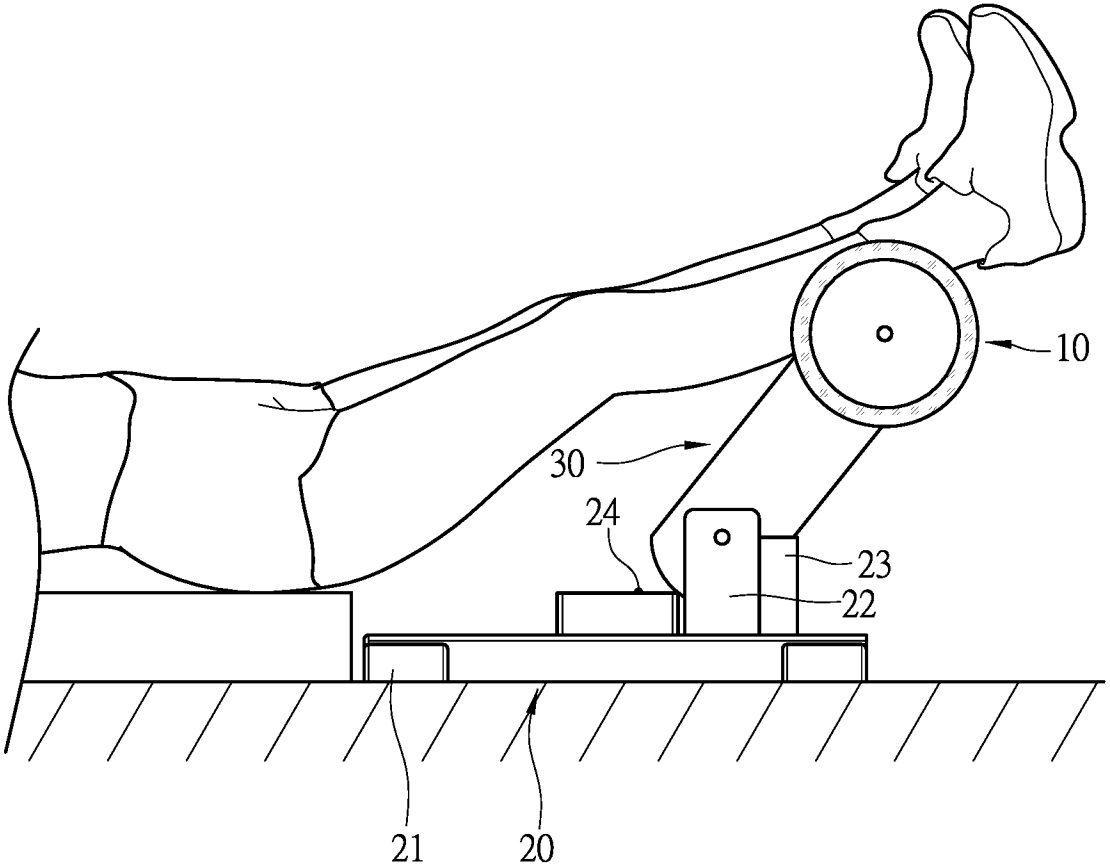
FIG. 10 is another schematic diagram showing the user lying down on the preferred embodiment according to the present invention.

In addition, when the massage mechanism is used, the angle of the swinging arm 30 can be adjusted freely, so the user can have the lower limb be massaged while lying down or sleeping. Please also refer to the FIGS. 8, 9 and 10, when the swinging arm 30 is brought up by the second motor 34 to form a raised state, the leg can be supported upwards and higher than the heart, which helps the blood return to the heart and the lungs for oxygen to help leg muscles to rest and relax, and then the massaging rollers 10 massage the muscle to eliminate soreness, fatigue and other discomforts for better blood circulation.

Figure 11:
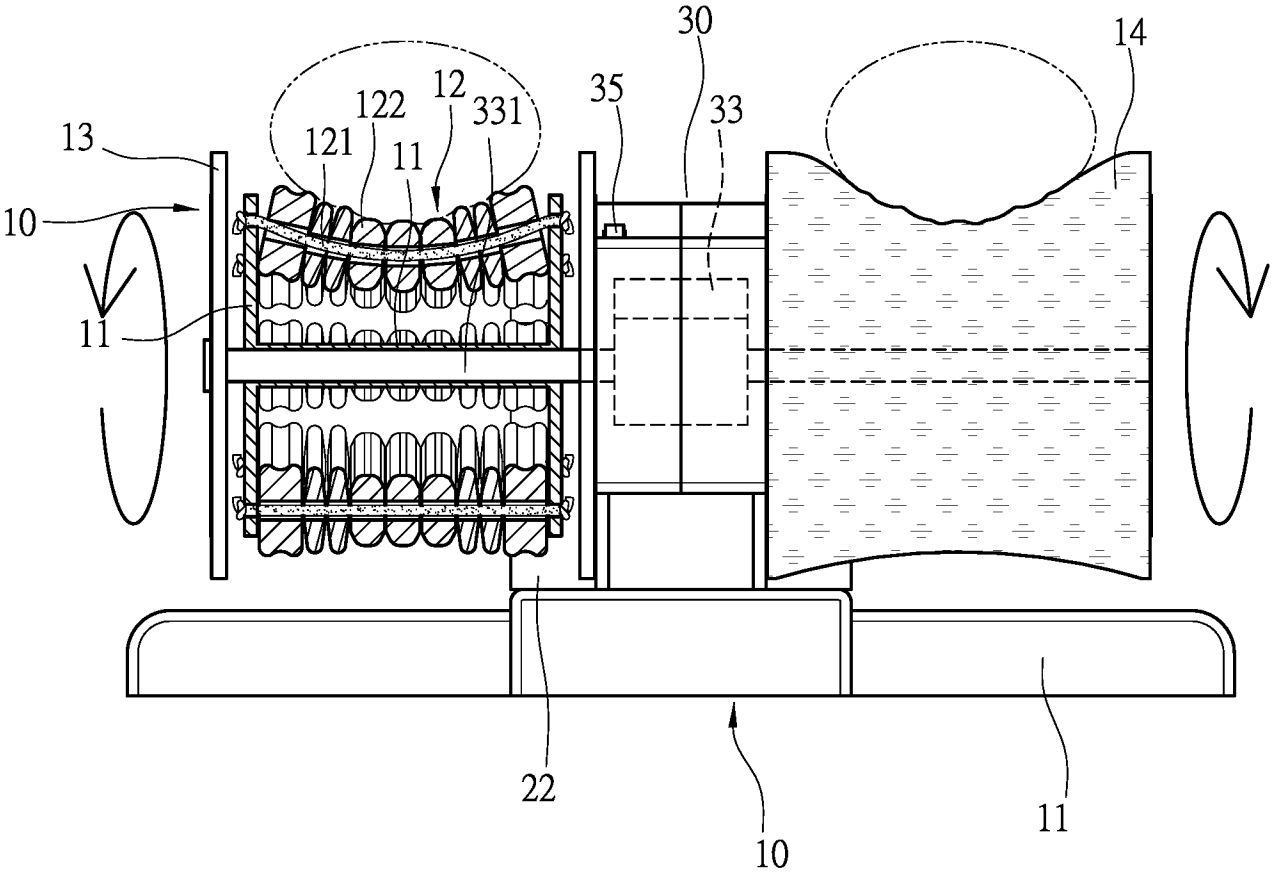
FIG. 11 is a cross-sectional view showing the massage roller massaging the leg portion according to the present invention.
Figure 12:
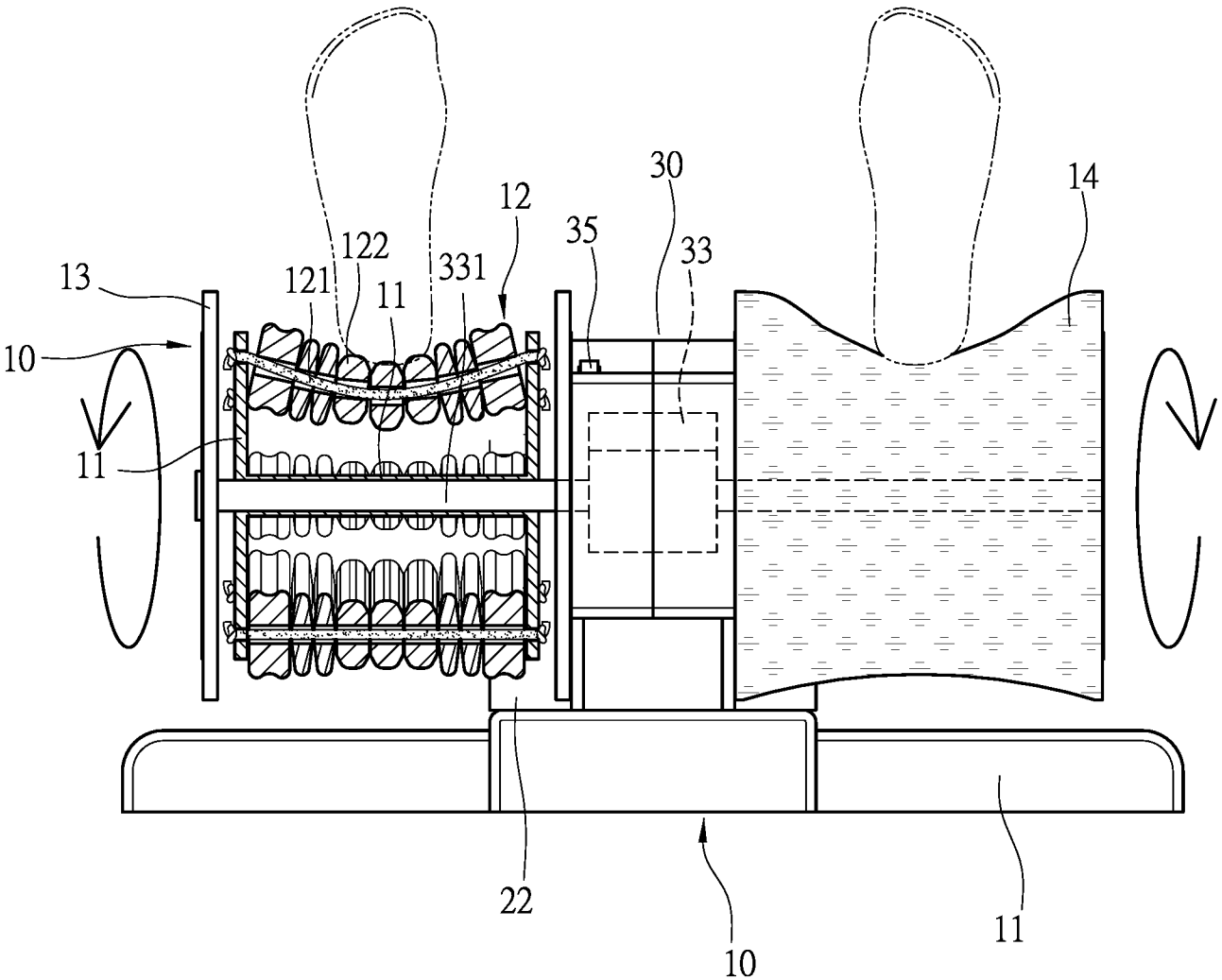
FIG. 12 is a cross-sectional view showing t the massage roller massaging the heel and ankle according to the present invention.
Figure 13:
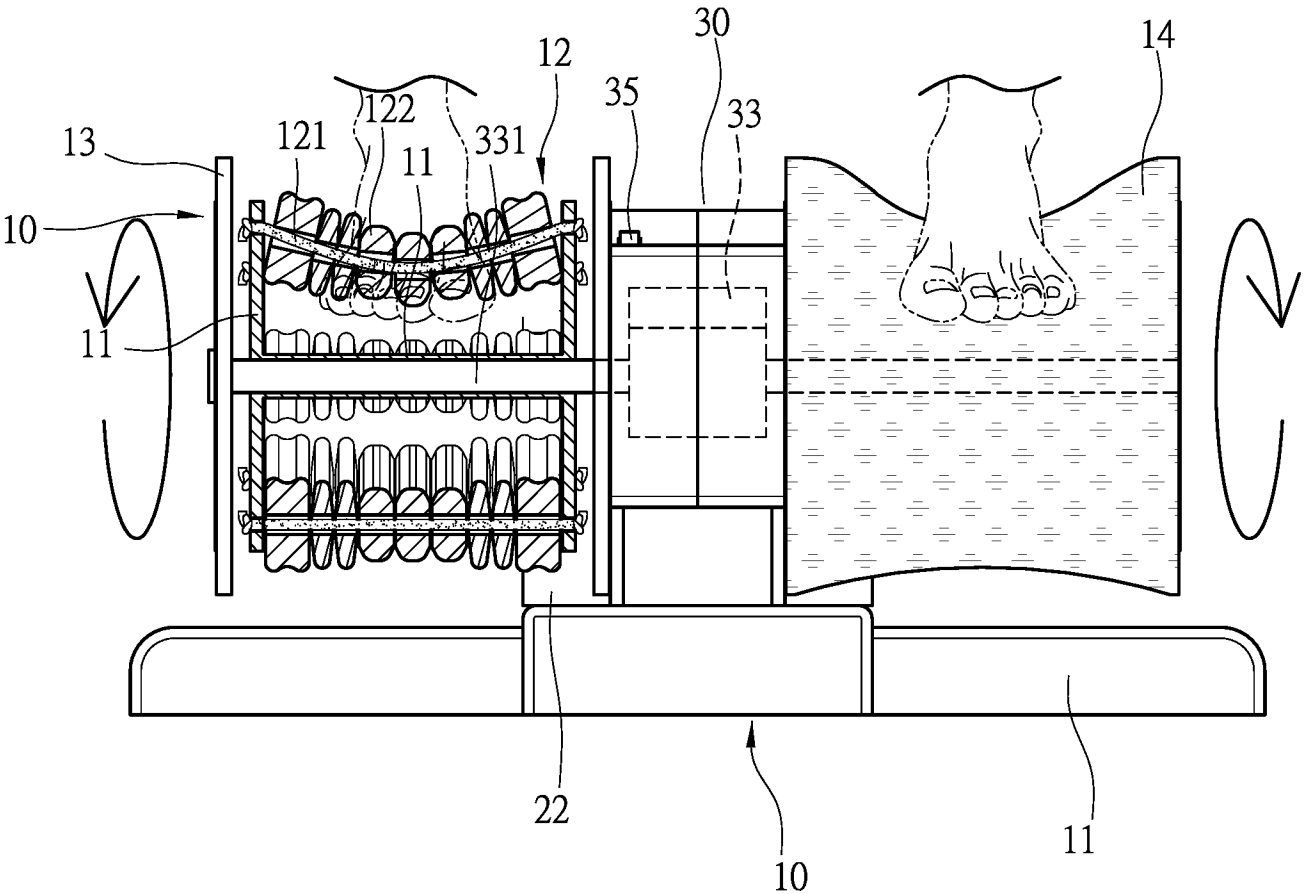
FIG. 13 is the preferred embodiment according to the present invention.

In summary, the massage device with the massage roller 10 mainly provides the massage effect to lower limbs, but it can also provide massage to upper limbs. When the massage roller 10 is driven by the first motor 33, please also refer to FIGS. 11, 12, and 13, each massaging unit 12 of the massage roller 10 utilizes the elastic band 121 to hold a plurality of the massage beans 122 between the two round disks 11 to provide cushioning effect to allow the massaging unit 12 to be deformed according to the curve of the human body curve to and achieve better massage effect. On the other hand, the massage beans 122 gently press on the muscles or bones which reduces the pain and discomfort during the massage process and helps to improve the comfort of the massage.

The swinging arm 30 can be swung to the bottom to be horizontal with the base 20, which greatly reduces the volume of the massage device for easy storage.

Although the present invention has been explained in relation to its preferred embodiment, it is to be understood that many other possible modifications and variations can be made without departing from the spirit and scope of invention as hereinafter claimed.

What is claimed is:

1. A massage device comprising:

a base having two opposing assembling posts at one end and a limiting baffle behind and between the two assembling posts;

a swinging arm having a massaging end and a swinging end, the massaging end provided with a respective massaging roller mechanism on two sides, a first motor configured to rotate the two massaging roller mechanisms, the swinging end disposed between the two assembling posts of the base, a second motor disposed between the swinging end and the two assembling posts and configured to drive the swinging arm to rotate around the base;

wherein each massage roller mechanism comprises two round disks and a plurality of massaging units between the two round disks, a shaft connecting the two round disks, a plurality of through apertures evenly and respectively disposed around the shaft on the two round disks, each massaging unit utilizing an elastic band to connect a plurality of massage beans, and the massaging units are secured onto the through apertures between the two round disks via the elastic bands.

2. The massage device as claimed in claim 1, wherein a side of each of the two round disks of each message roller mechanism is provided with an outer disk.

3. The massage device as claimed in claim 1, wherein two sides of the base are each provided with a foot stand, a first limit switch is mounted in front of the two assembling posts, a second limit switch is mounted on the swinging arm adjacent the swinging end, and the first and second limit switches are both are electrically connected to the second motor.

4. The massage device as claimed in claim 1, wherein the limiting baffle is U-shaped, and a highest point of the limiting baffle is lower than the two assembling posts such that the swinging arm is able to have a rotation angle larger than 90° relative to the base.

5. The massage device as claimed in claim 1, further comprising a cloth cover covering each massage roller mechanism.

6. The massage device as claimed in claim 1, wherein the second motor is fixed on the swinging end and has a shaft rod at two sides passing though the swinging end and held between the two assembling posts.

* * * * *